US005885312A

United States Patent [19]

Fruitman

[11] Patent Number: 5,885,312

[45] Date of Patent: Mar. 23, 1999

[54] GRINDING COMPOSITION USING ABRASIVE PARTICLES ON BUBBLES

[75] Inventor: Clinton O. Fruitman, Chandler, Ariz.

[73] Assignee: SpeedFam Corporation, Chandler, Ariz.

[21] Appl. No.: 877,154

[22] Filed: Jun. 17, 1997

[51] Int. Cl.[6] ..... B24D 3/34

[52] U.S. Cl. ..... 51/296

[58] Field of Search ..... 51/293, 296

[56] References Cited

U.S. PATENT DOCUMENTS

| | | | |
|---|---|---|---|
| 2,734,812 | 2/1956 | Robie | 51/296 |
| 2,806,772 | 9/1957 | Robie | 51/296 |
| 2,986,455 | 5/1961 | Sandmeyer | 51/296 |
| 3,925,034 | 12/1975 | Anna et al. | 51/296 |
| 5,472,461 | 12/1995 | Li | 51/296 |
| 5,578,362 | 11/1996 | Reinhardt et al. | 51/296 |
| 5,713,968 | 2/1998 | Fruitman et al. | 51/296 |

*Primary Examiner*—Deborah Jones
*Attorney, Agent, or Firm*—Snell & Wilmer, L.L.P.

[57] ABSTRACT

The instant invention relates generally to abrasive stones for use in processing workpiece surfaces. The abrasive stones generally are produced by combining an epoxy novalac resin mixture with microballoons and a catalyst. The mixture is put into a mold, cold pressed, and then cured, creating abrasive stones having a uniform surface and bulk structure with a uniform hardness, suitable for workpiece processing.

27 Claims, 3 Drawing Sheets

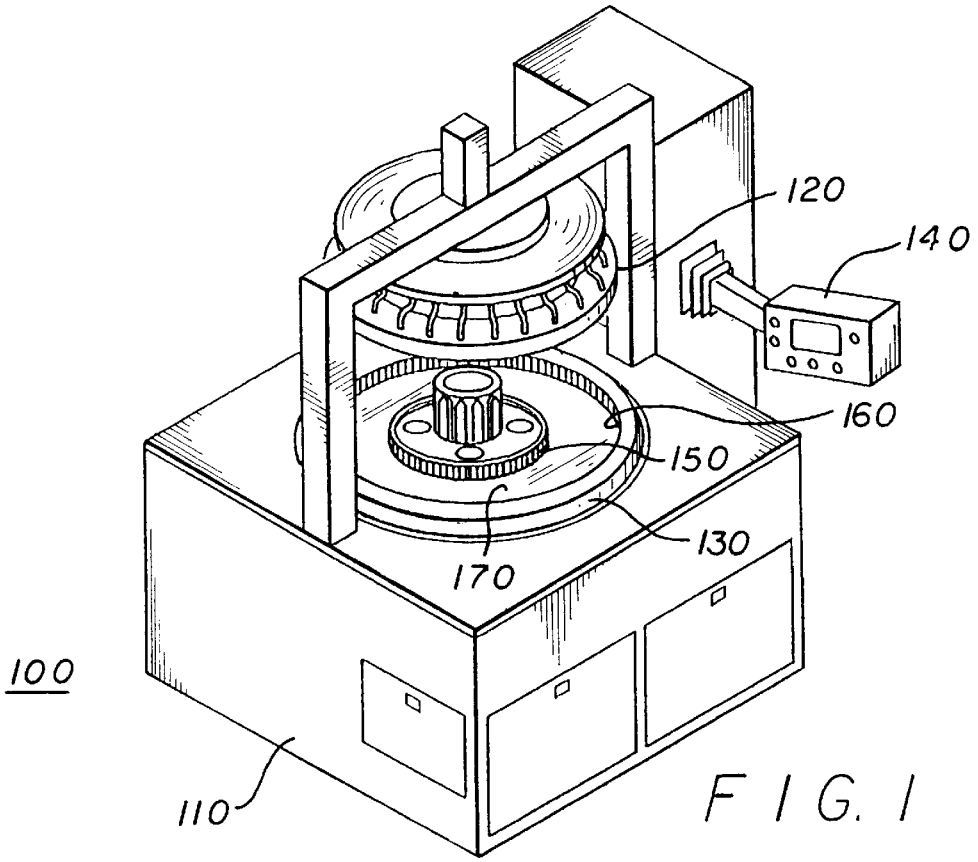
FIG. 1
FIG. 2
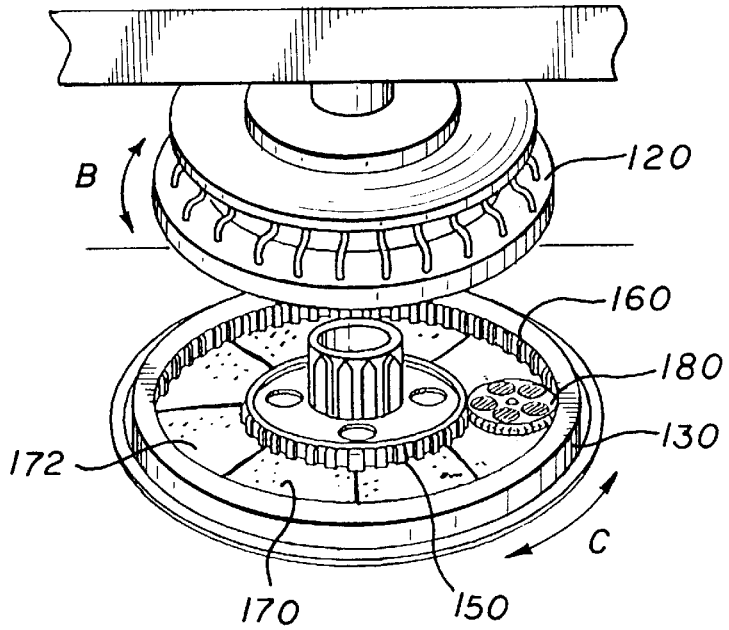

230
290
200
220
240
210

GRINDING COMPOSITION USING ABRASIVE PARTICLES ON BUBBLES

TECHNICAL FIELD

The present invention relates, generally, to abrasive foam grinding structures and, more particularly, to methods for manufacturing a resin-based composite structure including microballoons for controlling friability, hardness, and cell density of the abrasive foam grinding structures. The abrasive foam grinding structures are generally used to lap, grind or hone the surface of a workpiece, e.g., computer hard disks and the like.

BACKGROUND ART AND TECHNICAL PROBLEMS

Presently known abrasive foam grinding structures are known as "honing stones" and typically have open cell structures or closed cell structures. Stones having an open cell structure are generally made from a combination of Polyvinyl alcohol (PVA), starch, and a silicon carbide filler functioning as the abrasive material. An appropriate catalyst, for example sulfuric acid and/or formaldehyde, is added to the PVA, starch, and silicon carbide mixture to convert the mixture to a rubber-like mass with the starch particles randomly entrained therein.

The rubber-like mass is then flushed in a hot water shower to dissolve and flush out the starch from the composite. Upon flushing the starch from the rubber-like mass, a random distribution of holes having diameters in the range of about 50 to 150 microns is formed within the mass, creating a spongy material. The spongy material may then be impregnated with a stiffening agent, e.g. melamine, which penetrates through the random distribution of holes, coating the complex surfaces within the spongy material. Excess stiffening agent which accumulates within the holes may then be removed, for example, through centrifugal extraction or a subsequent rinsing process. The resulting stiffened spongy material is then dried and used to lap or grind the surfaces of workpieces (e.g. computer hard disks).

An alternative stiffening technique useful in open cell structures involves adding various co-polymers to the PVA before curing to enhance the stiffness of the finished spongy material.

Stones having closed-cell structures are typically produced by mixing a "Part A" and a "Part B" urethane resin together. With this process, one of the two parts is used to disperse an abrasive, such as silicon carbide, throughout the resin. While "Part A" and "Part B" are stored separately prior to mixing, upon being mixed together the composite resin mixture is quickly introduced into an injection mold, whereupon a spontaneous exothermic cross-linking reaction occurs. The exothermic reaction between the two resins generates a substantial amount of heat, which expands the resin blowing agents present within one or both of the resin components, forming foam or high density bubbles within the compound.

The blowing agents may be either chemical or physical. Chemical blowing agents generate gas through a chemical reaction, while physical blowing agents generate vapors upon exposure to heat or reduction in pressure. Accordingly, bubbles produced by the gases or vapors from the blowing agents become entrained within the cross-linked matrix, resulting in a porous, closed cell structure suitable for lapping or honing the surface of the workpieces.

When used to hone or lap workpieces, open-cell stones typically flake, liberating particulates at the stone-workpiece interface. To remove the stone particulates and particulates liberated from the workpiece, and to cool the interface which is heated by the grinding or polishing process, the workpieces are typically flushed with water or a water-based solution during processing. Because of the open cell structure, some of the particulates may penetrate into the stone's cell structure during flushing, resulting in "loading" of the debris within the stone. Consequently, the accuracy and precision of the workpiece honing process may be affected, for example, local stiffness deviations across the stone surface formed as a result of "loading".

Problems may also arise from incomplete mixing of "Part A" and "Part B" of the resin. Incomplete mixing may create non-homogeneous or insufficiently homogenous regions in the stone, leading to a non-uniform stone surface. A non-uniform stone surface, in turn, can cause uneven material removal from the workpiece, as well as scratches and other blemishes on the workpiece. Attempts to obviate this problem by increasing the mixing rate of "Part A" and "Part B" have been somewhat unsuccessful, because the cross-linking reaction rate is often faster than even the most sophisticated mixing techniques.

Closed-celled urethane stones are unsatisfactory in several additional regards. For example, the urethane stones comprise an inherently stiff composite structure. Consequently, agglomerates and nodules created from bubble surfaces as they are breached during stone dressing can scratch a workpiece if the nodules are not liberated from the stone and rinsed away. Moreover, both PVA-based stones and urethane-based stones require the use of highly toxic materials in their manufacture. This is particularly true of many isocyanide urethane resins.

Combining phenolic resins with a foaming agent and a catalyst is another well known process for making abrasive foam grinding structures. With this process, the catalyst creates an exothermic reaction which causes the foam to "explode", creating bubbles in the resin which get trapped therein as the resin cures.

Yet another method for making abrasive foam grinding structures is disclosed in U.S. Pat. No. 5,713,968 to Fruitman et al which is incorporated herein by reference. This method involves adding microballoons to a resin mixture during the mixing stages. The friability of the abrasive foam grinding structure can thereby be controlled by adjusting the size and density of the microballoons, as well as by adjusting the amount and composition of diluent, such as deionized water and ethanol, which is added to the resin during the mixing process. However, since the amount of diluent that may be added is limited by the resin to diluent ratio necessary to maintain a satisfactory structure, the potential for controlling the friability of the abrasive foam grinding structure by varying diluent amounts is somewhat limited. Also, this process requires the use of pressurized vessels to prevent air from mixing with the resinous compound and altering the porosity of the structure. For this reason and others, this particular method tends to be expensive to operate.

In summary, most of the presently known abrasive foam grinding structures and techniques for manufacturing them are unsatisfactory in several additional regards. Most known abrasive foam grinding structures do not grind or hone the surface of the workpieces in a uniform fashion, creating unsatisfactory workpiece surface finishes. In addition, imperfect dispersion of abrasives in the stones tends to yield agglomerates or nodules that project from the mean surface of the abrasive foam grinding structures and can cause scratching and surface imperfections in the workpiece. Moreover, the toxic nature of many of the components of known grinding or honing stones renders their manufacture, use, and disposal environmentally compromising and expensive. Finally, the cost of manufacturing most presently known stones is getting increasingly high, exacerbating the problem of limited stone life.

A new abrasive foam grinding structure composition and method for making and using the same is therefore needed which overcomes the shortcomings of the prior art.

SUMMARY OF THE INVENTION

The present invention provides an abrasive foam grinding, honing, and lapping material which overcomes many of the shortcomings of the prior art. In accordance with a particularly preferred embodiment of the present invention, a brittle, epoxy-novalac resin mixture is combined with microballoons to produce a sponge structure with highly desirable physical properties. In accordance with a further aspect of the present invention, an exemplary method of manufacturing the resin composite permits various physical and structural parameters of the stone to be tuned during manufacture.

In accordance with a further aspect of the present invention, highly consistent workpiece material removal rates may be obtained from run to run for a particular abrasive foam grinding structure and even from grinding structure to grinding structure as they are replaced.

In accordance with another aspect of the present invention, the toughness and, hence, the useful life of the abrasive foam grinding structure is enhanced.

In accordance with another aspect of the present invention, more uniform mechanical properties may be obtained across the surface and throughout the bulk of the stone.

In accordance with a further aspect of the invention, the porosity and friability of the material may be controlled by the addition of expanded microballoons, unexpanded microballoons, or a combination thereof, thus making it possible to achieve high porosity levels which are not limited by the amount of diluent that is added to the resin mixture.

In accordance with yet a further aspect of this invention, conventional mechanical mixing devices can be used to mix the resinous mixture before it is cured.

BRIEF DESCRIPTION OF THE DRAWING FIGURES

The present invention will hereinafter be described in conjunction with the appended drawing figures, wherein like numerals denote like elements, and:

FIG. 1 is a perspective view of a double sided flat honing machine;

FIG. 2 is an exploded perspective view of the upper portion of the honing machine of FIG. 1;

DETAILED DESCRIPTION OF PREFERRED EXEMPLARY EMBODIMENTS

Figure 3:
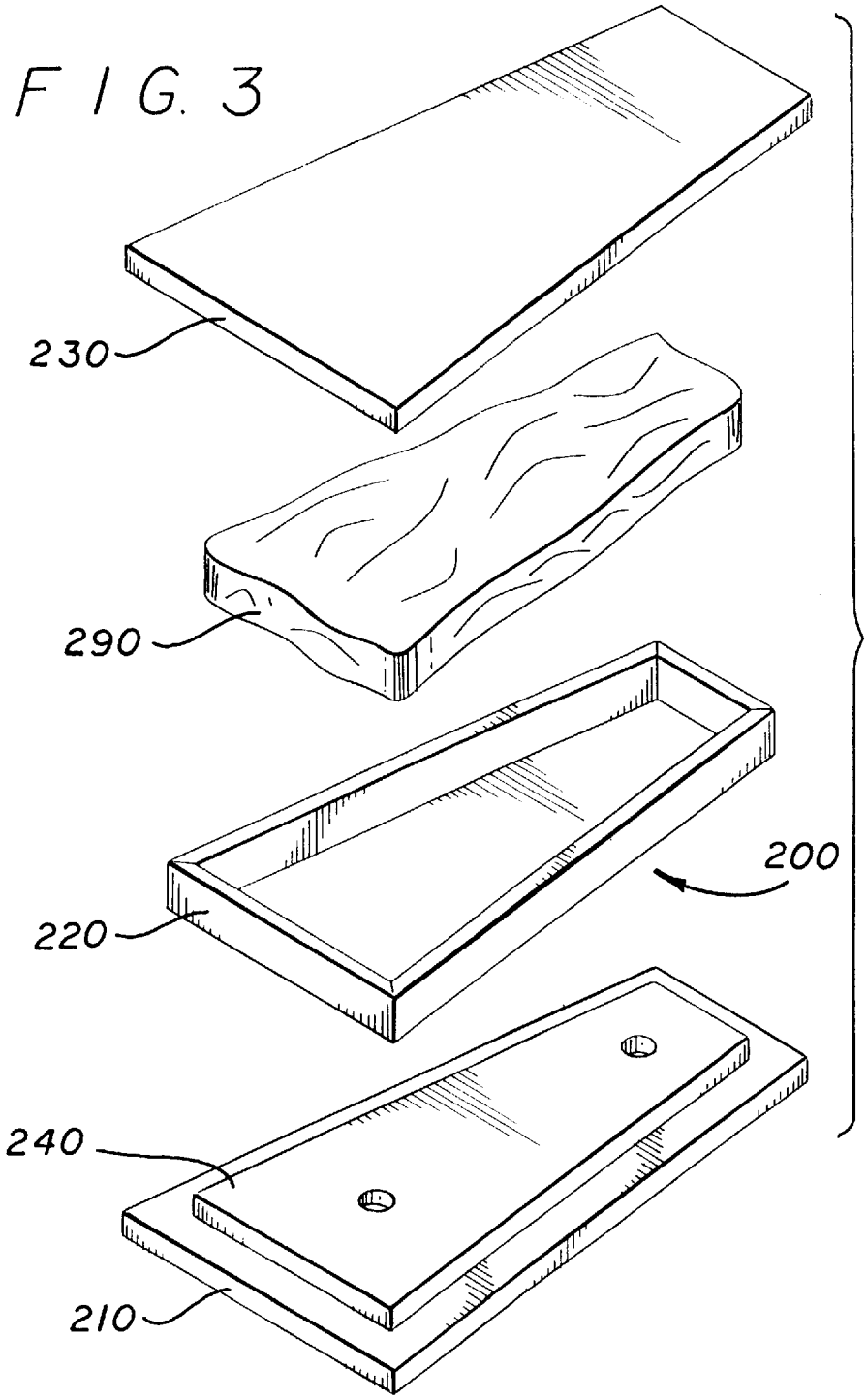
FIG. 3 is a perspective view of a mold used to produce foam grinding structures in accordance with the present invention.

The subject invention relates, generally, to abrasive foam grinding structures, or "honing stones," for use in processing workpiece surfaces. Although the workpiece to be processed may comprise virtually any article requiring a controlled finish, the present invention is conveniently described with reference to computer hard disks which require controlled surface finishes. It will be understood, however, that the invention is not limited to any particular type of workpiece or any particular type of surface finish.

Referring now to FIGS. 1 and 2, an exemplary honing machine 100 is shown. Honing machine 100 is configured to remove material from a workpiece (not shown in FIGS. 1 and 2), and suitably comprises a base 110, an upper platen 120, a lower platen 130 and a control panel 140 which is used to program the honing apparatus. Lower platen 130 suitably comprises a sun gear 150, and a ring gear 160. Each of platens 120 and 130 includes an abrasive material 170, (e.g., an abrasive stone) fixedly attached to one of its surfaces.

Referring now to FIG. 2, one or more workpieces to be honed are suitably placed in a wafer carrier 180 between the abrasive material 170 present on upper platen 120 and lower platen 130. Upper platen 120 is then lowered onto the workpiece, so that abrasive stone material 170 on the upper platen and abrasive stone material 170 on the lower platen contact both sides of each workpiece. Honing occurs when the upper platen and the lower platen are moved relative to the workpiece. In addition, a processing fluid which typically contains surfactants and lubricants that physically and chemically react with the surface of the workpiece may also be present during honing to enhance the stock removal and finish of the workpiece. Also, a coolant such as deionized water is typically added during processing to help flush debris from the surface of the stones, as well as to keep the workpiece cool during polishing.

Referring now to FIG. 2, abrasive material 170 on platens 120, 130 suitably comprises a plurality of generally pie-shaped abrasive stone segments 172. It should be noted, however, that abrasive material 170 may comprise any particular shape or configuration of grinding or honing stone; for example, a one-piece grinding stone may be used. In accordance with the illustrated embodiment in FIG. 2, each stone segment 172 is fixedly mounted to platens 120, 130, so that the stone segments 172 are secured thereon, preventing them from moving when normal operating stresses occur. For optimum finishing of each workpiece in carrier 180, it is desirable that the surface of each stone segment 172 be uniform and free from defects.

In a preferred embodiment of the present invention, one or more workpieces are placed in carrier 180 during processing. Carrier 180 is configured to rotate, orbit, or a combination thereof across abrasive material 170. In addition, abrasive material 170 on platens 120, 130 are also rotated at various speeds during honing to enhance the stock removal, flatness and finish of the workpieces. The rotation of carrier 180 and platens 120, 130 are indicated by arrows A, B, and C respectively. Moreover if sun gear 150 and ring gear 160 (i.e., the gears that cause carrier 180 to rotate and orbit) rotate at different speeds, i.e., at different radians per minute, carrier 180 will orbit or translate around the polishing material as indicated by arrow D. As a result, both oppositely disposed surfaces of each workpiece are processed simultaneously, so that a uniform and predictable removal rate from each side is achieved.

As mentioned previously, to obtain optimum honing of each workpiece, it is desirable that the mechanical surface of each stone segment 172 be uniform across the entire surface of each segment 172, as well as across the entire abrasive material 170. Furthermore, it is desirable to maintain uniform mechanical characteristics of each stone segment as the stone segments wears from, inter alia, the processing of workpieces. Accordingly, the stone segments may be conditioned, for example, by passing a diamond dressing plate over the surface of the stone segments. For a more detailed discussion of conditioning grinding or honing stones, see U.S. Pat. No. 5,713,968 to Fruitman et al., which is incorporated herein by reference.

In accordance with a preferred embodiment of the present invention, typical removal rates from aluminum hard disk substrates is on the order of about 1 to about 1.5 micro inches every 3.5 minutes. To obtain the desired removal rates, in addition to rotating the polishing surfaces and the carrier, force is applied to the surface of the workpieces by platens 120, 130 on the order of about 0.5 to about 1.5 lbs per square inch, and preferably about 1 lb per square inch.

Figure 4:
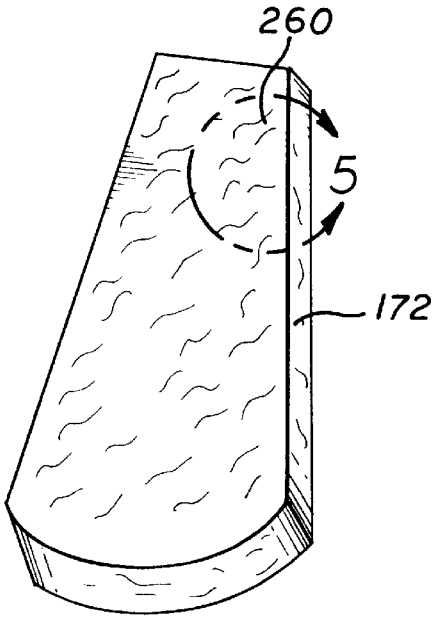
FIG. 4 is a perspective view of an abrasive grinding or honing stone.
Figure 5:
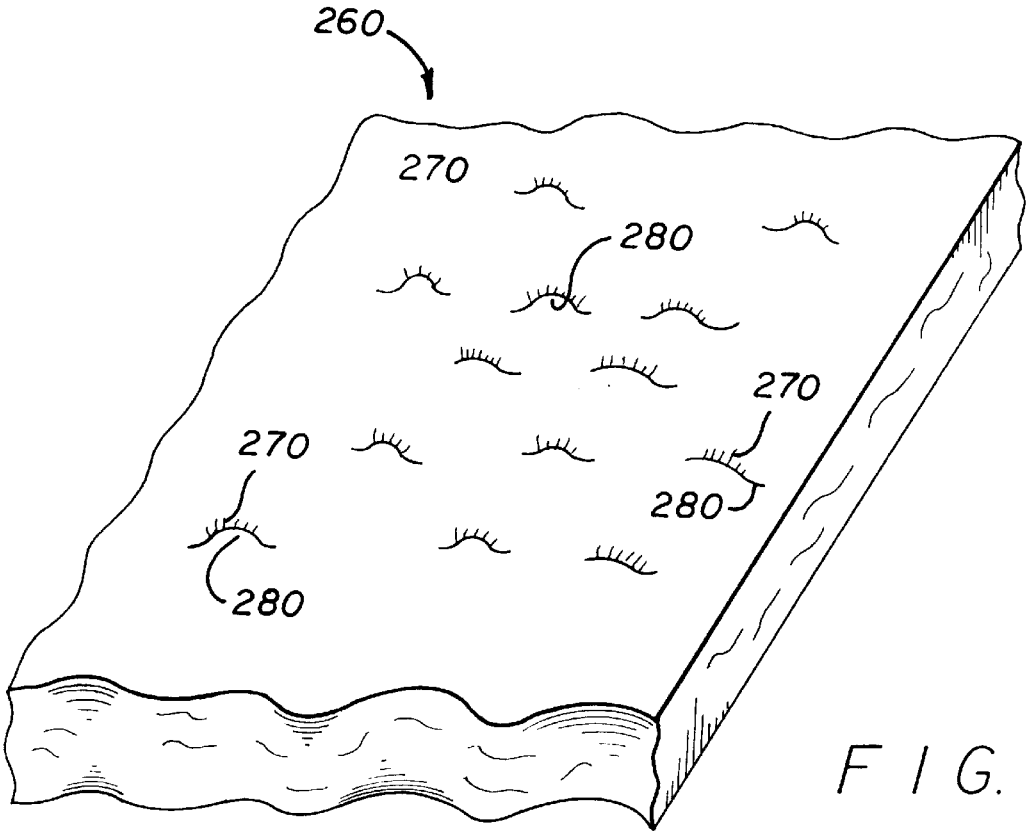
FIG. 5 is an exploded top plan view of the surface of the abrasive stone of FIG. 4.

Referring now to FIGS. 3–5, the manner in which the exemplary abrasive stones of the present invention are manufactured will now be described. In accordance with a particularly preferred embodiment of the present invention, a brittle, epoxy-novalac resin is suitably employed, such as Shell Chemical's Epon product numbers 813 or 828, and novalac resin flakes are also employed, such as product numbers Epon 1031 or SU8. While being agitated by, for example, a well known mixing device, the epoxy resins are heated to a temperature between about 150° F. and 175° F., to dissolve the novalac flakes. After the novalac flakes are dissolved, the resin is cooled to room temperature and a heat activated catalyst such as Shell's Epicure W (an aromatic amine), abrasive elements such as diamond or silicon carbide particles, and fillers are mixed with the resin to create an abrasive resinous mixture. Shear mixing the materials enhances the dispersion of the abrasive elements throughout the mixture, and the addition of the catalyst promotes cross-linking of the resin mixture during the curing stage. Moreover, the added fillers help create the proper consistency of the mixture and may comprise materials such as wood flour, metal powder, or any combination thereof. In accordance with a preferred embodiment of the invention, the filler comprises hard wood flour. Also, although a preferred embodiment of the present invention employs a suitable epoxy-novalac resin, one skilled in the art will appreciate that virtually any material having similar properties may be employed, such as, for example, polymethacrylates, phenolics, and the like. In addition, suitable co-polymers, hardening agents, blowing agents and/or defoamers may be added to the abrasive resinous mixture, as desired.

The quantity of abrasive elements or material added to the mixture is driven by the desired wear resistance and finish of the finished honing material. However, when using diamonds below about 20 microns in size, a minimum of about 40 carats per cubic inch of resin mixture is preferred. In accordance with a preferred embodiment of the invention, for a fine finish on glass, hard metals, composites etc., the abrasive particles are preferably resin-bond diamond particles with a mean particle diameter of about 3.0 to 12.0 $\mu$m and preferably about 7.0 $\mu$m. For higher stock removal and a lower quality finish, larger particles may be employed. Similarly, for a finer finish and lower stock removal, smaller particles may be employed.

In a preferred embodiment of the present invention, unexpanded microballoons are added to the abrasive resin catalyst mixture after the abrasive particles, catalyst, resin and the like are mixed. The microballoons are relatively small but will expand to between about 20 and 80 microns in diameter, and typically comprise vinyl, acrylonitrile or other elastic material filled with gas under compression. When heated, the skins of the microballoons soften allowing them to expand. In the unexpanded state the microballoons can occupy a volume of about 1/50 of their total free expansion volume at standard pressure. In accordance with a preferred embodiment, the unexpanded microballoons comprise microballoons manufactured by Akzo Nobel's Expancel Corporation of Sweden under the product names "DU20 and DU80 Unexpanded Microballoons." However, one skilled in the art will appreciate that any suitable unexpanded microballoon may be used. After the addition of the above fillers, the mixture comprises a thick sticky syrup.

In a preferred embodiment of the present invention, expanded microballoons (i.e., microballoons filled with gas and not compressed) are then added to the mixture. Preferably, the microballoons are approximately 80 $\mu$m in diameter and are in a relaxed state at standard pressure and temperature; ie., 1 atmosphere of pressure and 25° C. The expanded microballoons convert the syrupy mixture to a firm easy-to-mold putty or dough like substance. In accordance with a preferred embodiment, the expanded microballoons are manufactured by Akzo Nobel's Expancel Corporation of Sweden under the product name "DE80 Expanded Balloons." The table below is a suitable exemplary grinding stone formulation of the present invention:

| comp. | RESIN (EPON 813) | RESIN (EPON 828) | RESIN FLAKES (EPON 1031) | CATALYST (EPICURE W) | 7.5 MICRON DIAMOND | WOOD FLOUR | UMB (DU 20) | UMB (DU 80) | EMB (DE 80) |
|---|---|---|---|---|---|---|---|---|---|
| wt. % | 21.22% | 7.07% | 12.13% | 9.70% | 30.08% | 6.47% | 5.74% | 5.74% | 1.85% |

Referring now to FIG. 3, the molding and shaping of the grinding stone composition will now be discussed. After preparation of the putty-like substance, it is pressed into a mold 200. In the preferred embodiment of the invention, mold 200 suitably includes a lower cap plate 210, an upper cap plate 230, and a walled body 220. In accordance with this aspect of the invention, the insides of body 220 and cap plates 210, 230 may be lined with a release film, such as a fluoropolymer tape or the like. In a further embodiment, of the invention, a stone backing plate 240 having bores 242 for mounting the finished stone-backing plate unit onto the machine platens may be placed and substantially centered on the bottom cap plate 210. The backing plate 240 can be either disposable or recyclable.

In accordance with one embodiment of the invention, the putty-like substance is cold pressed to a uniform thickness onto backing plate 240 in mold 200. In accordance with yet another preferred embodiment, the putty-like mixture first is rolled to a uniform thickness and cut with a die in the shape of backing plate 240; and then placed onto the backing plate in mold 200. In either case, the putty-like mixture fills approximately 65% of the free space in the mold, allowing for approximately 35% expansion. After the putty-like mixture is added, cap plates 210, 230 and mold walls 220 are clamped together and heat is applied. At this point, the mixture expands and the catalyst causes the polymer to become cross-linked.

In accordance with yet a further embodiment of the present invention, a sheet of wax paper or siliconized release film 250 may first be placed between upper cap plate 230 and the putty-like substance to prevent the substance from sticking to the plate. Preferably, mold 220 is made from one-fourth inch (¼") steel that is coated with a non-stick material, such as, for example, Teflon. Mold 220 may comprise any desired shape; however, in the preferred embodiment, the interior of the mold is generally pie shaped.

After compressing the putty-like substance in mold 220 to obtain the proper uniform thickness, upper cap plate 230 is removed and the release paper 250 which still resides on the substance is trimmed. Mold 220 is then capped and placed in a heating apparatus, where it is heated to a temperature of about 80° C. to about 100° C., preferably about 93° C., for about 1 to 2 hours. The mold is then heated at about 120° C. to about 180° C., preferably about 150° C., for between about 3 to 4 hours. This closes the microballoon and abrasive resin mixture inside the mold to expand and to cure.

A typical resulting stone segment 172 is illustrated in FIG. 4. As shown more clearly in FIG. 5 (a close-up view of stone 172), because abrasive particles 270 are on the order of about 7 $\mu$m and microballoon structures 280 are on the order of about 80 $\mu$m, several abrasive particles 270 may reside between and on top of the resin reinforced single microballoon structures 280. In accordance with this aspect of the invention, the porosity of the microballoon structure helps to minimize debris loading. Moreover, the bond posts between the balloon cells and the peaks of the balloon domes on the wear surface act as stress concentrators for the attached abrasive particles, enhancing removal rates. The rigidity of the stone mixture in the preferred embodiment offers up to about a 33% improvement in the flatness of the processed workpieces over conventional processing.

It should be understood that the foregoing description is of preferred exemplary embodiments of the invention and that the invention is not limited to the specific forms shown or described herein. Various modifications may be made in the design, arrangement, and type of elements disclosed herein, as well as the steps of using the invention without departing from the scope of the invention as expressed in the appended claims.

I claim:

1. A method for producing an abrasive stone for processing a workpiece, comprising the steps of:

forming a resin mixture by mixing and heating epoxy and novalac resin material;

creating an abrasive resinous mixture by cooling said resin mixture and adding and mixing abrasive particles and a catalyst with said resin mixture;

creating an intermediate abrasive substance by adding and mixing unexpanded microballoons and fillers with said abrasive resinous mixture;

adding expanded microballoons to said abrasive substance and mixing said expanded microballoons and said abrasive substance until said expanded microballoons are properly dispersed within said abrasive substance and a moldable abrasive mixture is formed;

molding said abrasive mixture to a shape;

placing said abrasive mixture in a warming chamber to activate said catalyst and thereby cure said abrasive mixture into an abrasive stone.

2. The method as recited in claim 1, wherein said step of forming a resin mixture is performed by heating said epoxy and novalac resin material at a temperature in the range of about 150° F. to about 175° F.

3. The method as recited in claim 1, wherein said fillers comprise hard wood flour.

4. The method as recited in claim 1, wherein said abrasive particles are resin-bond diamond particles having a mean particle diameter of about 3.0 $\mu$m to about 12.0 $\mu$m.

5. The method as recited in claim 4, wherein the quantity of abrasive particles in said abrasive resinous mixture is about 40 carats per cubic inch of resin mixture.

6. The method as recited in claim 1, wherein said step of creating an abrasive resinous mixture further comprises adding additional compounds selected from a group consisting of co-polymers, hardening agents, blowing agents and defoamers.

7. The method as recited in claim 1, wherein said step of molding said abrasive mixture comprises cold pressing said abrasive mixture into a mold having a lower cap plate, an upper cap plate and a walled body.

8. The method as recited in claim 7, wherein an inside surface of said mold is lined with a release film to prevent said abrasive mixture from sticking to said inside surface of said mold.

9. The method as recited in claim 7, wherein said abrasive mixture is pressed onto a backing plate in said mold.

10. The method as recited in claim 1, wherein said step of placing said abrasive mixture in a warming chamber, comprises heating said abrasive mixture to about 93 degrees Celsius for about 1 to 2 hours.

11. The method as recited in claim 10, further comprising the step of heating said abrasive mixture to about 150 degrees Celsius for about 3 to 4 hours.

12. An abrasive stone used to process workpieces, comprising:

an abrasive resinous mixture comprising a mixture of epoxy and novalac resin material and abrasive particles, a catalyst and fillers; and unexpanded microballoons; and expanded microballoons;

wherein said abrasive stone is formed by mixing said abrasive resinous mixture, said unexpanded microballoons and said expanded microballoons in a mixing chamber and then molding and curing so that said abrasive stone has shape, density and abrasiveness.

13. The abrasive stone as recited in claim 12, comprising about 40 to 42% by weight resin, about 8 to 10% by weight catalyst, about 28 to 32% by weight abrasive particles, about 5 to 8% by weight filler, about 9 to 13% by weight unexpanded microballoons and about 1 to 3% by weight expanded microballoons.

14. The abrasive stone as recited in claim 13, wherein said resin comprises epoxy resin and novalac resin flakes.

15. The abrasive stone as recited in claim 13, wherein said abrasive particles comprises resin-bond diamond particles.

16. The abrasive stone as recited in claim 13, wherein said filler comprises hard wood flour.

17. A method for producing an abrasive stone for processing a workpiece, comprising the steps of:

forming a resin mixture by mixing and heating epoxy and novalac resin material;

creating an abrasive mixture by cooling said resin mixture and adding and mixing abrasive particles, a catalyst, fillers, unexpanded microballoons and expanded microballoons with said resin mixture.

transferring said abrasive mixture into a mold; and curing said abrasive mixture by first baking said abrasive mixture at about 80–100° C. for about 1–2 hours and then baking said abrasive mixture at about 120–180° C. for about 3–4 hours.

18. The method as recited in claim 17, wherein said step of curing comprises baking said abrasive mixture at about 93° C. for about 1–2 hours and then baking said abrasive mixture at about 150° C. for about 3–4 hours.

19. The method as recited in claim 17, wherein said abrasive mixture comprises about 40 to 42% by weight resin mixture, about 8 to 10% by weight catalyst, about 28 to 32% by weight abrasive particles, about 5 to 8% by weight filler, about 9 to 13% by weight unexpanded microballoons and about 1 to 3% by weight expanded microballoons.

20. A method for producing an abrasive stone for processing a workpiece, comprising the steps of:

forming a resin mixture by mixing and heating epoxy and novalac resin material;

creating an abrasive resinous mixture by cooling said resin mixture and adding and mixing abrasive particles and a catalyst with said resin mixture;

adding and mixing microballoons with said abrasive resinous mixture;

adding and mixing fillers with said abrasive resinous mixture;

molding said abrasive resinous mixture to a shape;

placing said abrasive resinous mixture in a warming chamber to activate said catalyst and thereby cure said abrasive mixture into an abrasive stone.

21. The method of claim 20, wherein said microballoons comprise unexpanded microballoons.

22. The method of claim 20, wherein said microballoons comprise expanded microballoons.

23. The method of claim 20, wherein said microballoons comprise a mixture of expanded and unexpanded microballoons.

24. An abrasive stone used to process workpieces, comprising:

an abrasive resinous mixture formed by mixing a resinous mixture of epoxy and novalac resin material with abrasive particles, a catalyst and fillers; and microballoons;

wherein said abrasive stone is formed by mixing said abrasive resinous mixture and said microballoons in a mixing chamber and then molding and curing said abrasive stone so that said abrasive stone has an appropriate shape, density and abrasiveness.

25. The abrasive stone as recited in claim 24, wherein said microballoons comprise unexpanded microballoons.

26. The abrasive stone as recited in claim 24, wherein said microballoons comprise expanded microballoons.

27. The abrasive stone as recited in claim 24, wherein said microballoons comprise a mixture of unexpanded and expanded microballoons.

* * * * *